US005235386A

United States Patent [19]

Yano et al.

[11] Patent Number: 5,235,386

[45] Date of Patent: Aug. 10, 1993

[54] CHARGING DEVICE HAVING CHARGING MEMBER, PROCESS CARTRIDGE AND IMAGE FORMING APPARATUS

[75] Inventors: Hideyuki Yano, Yokohama; Koichi Tanigawa, Tokyo; Akihiko Takeuchi, Yokohama; Hiroshi Sasame, Yokohama; Yasumasa Ohtsuka, Yokohama; Takayasu Yuminamochi, Tokyo; Hiroto Hasegawa, Kawasaki; Hideo Nanataki; Kazuaki Ono, both of Tokyo, all of Japan

[73] Assignee: Canon Kabushiki Kaisha, Tokyo, Japan

[21] Appl. No.: 838,900

[22] Filed: Feb. 21, 1992

[30] Foreign Application Priority Data

Feb. 22, 1991 [JP] Japan ..... 3-050668

[51] Int. Cl.[5] ..... G03G 15/02

[52] U.S. Cl. ..... 355/219; 361/225

[58] Field of Search ..... 355/219; 361/221, 225; 29/125, 132

[56] References Cited

U.S. PATENT DOCUMENTS

| | | | |
|---|---|---|---|
| 4,851,960 | 7/1989 | Nakamura et al. | 361/225 |
| 4,967,231 | 10/1990 | Hosoya et al. | 355/219 |
| 5,089,851 | 2/1992 | Tanaka et al. | 355/219 |
| 5,112,708 | 5/1992 | Okunuki et al. | 361/225 X |
| 5,126,913 | 6/1992 | Araya et al. | 361/225 |
| 5,140,371 | 8/1992 | Ishihara et al. | 355/219 |
| 5,168,309 | 12/1992 | Adachi et al. | 355/219 |

FOREIGN PATENT DOCUMENTS 410483 1/1991 European Pat. Off. .

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

A charging device including a movable member to be charged, and a charging member which is contactable to the member to be charged so as to charge the member to be charged, wherein the coefficient of dynamic friction between the member to be charged and a surface of the charging member contactable to the member to be charged is not lower than 0.4.

20 Claims, 3 Drawing Sheets

CHARGING DEVICE HAVING CHARGING MEMBER, PROCESS CARTRIDGE AND IMAGE FORMING APPARATUS

FIELD OF THE INVENTION AND RELATED ART

The present invention relates to a charging device including a charging member contactable to a member to be charged such as image bearing member to charge the member to be charged, a process cartridge including such a charging member, and an image forming apparatus including such a charging member.

For the sake of convenience, the description will be made as to an example of an image forming apparatus, such as an electrophotographic apparatus and an electrostatic recording apparatus.

In an image forming apparatus such as an electrophotographic apparatus, a corona charger (or corona discharger) as a non-contact type charger having a wire electrode and a shield electrode enclosing the wire electrode is widely used as a means for electrically charging a surface of a member to be charged. Examples of such a member include an image bearing member, including e.g., a photosensitive member, a dielectric member,, etc. The above corona charger is effective for uniformly charging to a predetermined polarity the member to be charged. However, such apparatus have a drawback in that a high voltage source is required, the charging efficiency is low, relatively large amount of ozone is produced by the corona discharging action, and maintenance is required to be maintained for the purpose of retaining the uniform chargeability, including providing cleaning means for cleaning the corona wire and cleaning the wire by such cleaning means relatively frequently.

On the other hand, a contact type charging means in which a charging member supplied with a voltage is contacted to the member to be charged has recently attracted considerable attention and has been brought into practical use.

FIG. 8 shows an example of such a contact type charging system, wherein reference numeral 3 designates an electrophotographic photosensitive member in the form of a drum (hereinafter referred to as "photosensitive drum") in an electrophotographic apparatus. It is the member to be charged and is rotated in a predetermined peripheral speed (process speed) in the direction indicated by an arrow a. A charging member 1 in the form of a roller comprises an electroconductive member (hereinafter, referred to as "charging roller").

The charging roller 1 is disposed substantially in parallel with the drum generatrix of the photosensitive drum 3 so that it is pressed to the photosensitive drum 3 with a predetermined pressing force. The charging roller 1 functions as a follower roller which is rotated in accordance with the rotation of the photosensitive drum 3.

In the apparatus as shown in FIG. 8, when a predetermined voltage is applied from a source of electricity S to the charging roller 1, discharge is effected in a minute gap or gaps between the charging roller 1 and the photosensitive drum 3. As a result, the peripheral surface of the rotated photosensitive drum 3 is subjected to a charging operation in a contact type process so that the above peripheral surface may have a predetermined potential and a predetermined polarity.

The voltage to be applied to the charging roller 1 may be a DC voltage alone. However, when a superposition of an AC voltage and a DC voltage corresponding to a predetermined charging voltage (i.e., a DC biased AC voltage) is applied to the charging roller 1, unevenness or non-uniformity in the charging in the form of dots can be prevented. More specifically, as described in U.S. Pat. No. 4,851,960, when an alternating electric field having a peak-to-peak voltage which is twice or more that of a charge initiation voltage is formed between the charging member and the member to be charged, the unevenness in the charging of the member to be charged can be prevented. The "charge initiation voltage" used herein refers to a voltage corresponding to a DC voltage which can initiate the charging of the member to be charged when such a DC voltage is applied to the member to be charged.

Around the photosensitive drum 3, there are disposed in addition to the charging roller 1 as the charging means, image information exposure means, toner developing means, toner image transfer means, cleaning means for the photosensitive drum or the like which constitute image forming process means, so as to provide an image forming mechanism. However, they are omitted in FIG. 8 for simplicity.

In the contact type charging device as described above, when the resistance (or resistivity) of the charging member 1 is too high, improper charging or charging failure is liable to occur, since a current required for the charging is difficult to flow through such a charging member 1. In such a case, the occurrence of the above improper charging also depends on the voltage to be applied to the charging member 1. On the other hand, in a case where the resistance of the charging member 1 is too low, when a defect having a low dielectric (or electrical) strength such as a pin hole is present or produced on the surface of the member 3 to be charged, the current passing through the charging member 1 is concentrated on such a defect, whereby the other portion of the surface of the member to be charged is not properly charged. As a result, the range of the resistance which the charging member should have is restricted to an appropriate range which does not pose the two problems as described above. Such an appropriate range of the resistance may generally be $10^5$ to $10^6$ Ω when it is measured by using a resistance measurement method as shown in FIG. 2. Accordingly, the resistance of the charging member has been controlled by adding and dispersing an electroconductive filler in a material constituting the charging member.

The resistance measurement method as shown in FIG. 2 is described. In this figure, the charging member 1 comprises a charging roller which comprises an electroconductive metal core la comprising iron, SUS (stainless steel), etc., and an electroconductive elastic layer 1*b* disposed thereon comprising a rubber, resin, etc. The conductive elastic layer 1*b* is molded by using a mold, etc., into a roller form concentrically and integrally with the metal core 1*a*. A metal tape 20 such as aluminum foil having a width of 10 mm as an electrode is wound about the outer peripheral surface of the conductive elastic layer 1*b* constituting the charging roller 1 so that it is caused to closely contact the above outer peripheral surface. Then, an electric source 21 for providing a voltage of 50 V and an ampere meter (or ammeter) 22 are connected in series between the electrode 20 and the metal core la of the charging roller 1, and the strength (or intensity) I of the current passing between the electrode 20 and the metal core la through the conductive elastic layer 1*b* is read by means of the ammeter 22. On the basis of the strength of the current measured in such a manner, the resistance (or resistivity) R of the charging roller 1 as the charging member is calculated according to a formula R=50 (V)/I.

As described above, the charging member 1 is required to have a uniform distribution of the resistance thereof with respect to a surface to be charged so as not to cause the improper charging or charging failure due to a variation in the resistance of the charging roller. FIG. 9 shows a case wherein the charging roller 1 has an uneven distribution of resistance in the longitudinal direction thereof, i.e., the charging roller 1 shows a variation in the height of the resistance. When the charging roller 1 has such an uneven distribution, a higher voltage is applied to a portion of the charging roller having a higher resistance. As a result, a portion of the surface to be charged corresponding to such a portion of the charging member is not sufficiently supplied with a voltage, and, therefore, the improper charging or charging failure may occur in some cases.

Such a phenomenon may also occur in a case where the surface of the charging member 1 picks up a contaminating substance such as dust or toner. In a case where an insulating toner is used as a developer in an image forming apparatus such as an electrophotographic apparatus, when such an insulating toner contaminates the surface of the charging member 1 disposed in contact with the image bearing member 3, the resistance of the charging member is considerably increased.

In addition, an external additive such as silica, zinc stearate, strontium titanate, and PMMA (polymethyl methacrylate) particles may externally be added to the developer for the purpose of improving the developer characteristics. However, such an external additive not only has a high resistance but also has a particle size as small as several submicrons and therefore, it may pass the cleaning member for cleaning the image bearing member 3 to contaminate the charging member. When such a phenomenon occurs, the charging performance or chargeability of the charging member may be deteriorated in some cases.

Particularly, when the surface of the charging member 1 has a small friction coefficient (or coefficient of friction), the above contamination is less liable to be attached to the surface of the charging member 1. Accordingly, when the charging member 1 is not uniformly contacted to the image bearing member 3, the contaminating substance attached to the charging member 1 is scraped off or rubbed off with the image bearing member 1 in a portion wherein the contact between the charging member 1 and the image bearing member 3 is strong. On the other hand, in a portion wherein the contact therebetween is weak, the contaminating substance remains on the charging As a result, unevenness in the contamination deposited on the charging member becomes considerable and it is liable to cause partial or local charging failure (or improper charging).

In addition, in the case an image forming apparatus such as an electrophotographic apparatus, when the charging means for charging, the image bearing member thereof includes the contact type charging device as described above, toner which has passed through the cleaning member (not shown in FIG. 8) is pressed to the image bearing member by the charging member 1 contacted to the image bearing member 3 and therefore, there is liable to occur a phenomenon wherein the toner is fused to the surface of the image bearing member 1. Such a phenomenon of toner fusion becomes noticeable in a system wherein a voltage including an AC voltage is applied to the charging member 1 to effect the charging.

The fused toner, does not transmit light and, therefore, in a reverse development system wherein the toner is attached to a portion of the latent image having a low potential, the potential of the surface of the image bearing member is not decreased in the exposed portion thereof even when it receives the exposure light. As a result, the portion carrying the fused toner provides an image having image dropouts (or white dots). For the purpose of preventing the occurrence of such a phenomenon, European Laid-Open patent application No. EP410483 AI disclose a technique wherein styrene type copolymer particles or polymethyl methacrylate type resin (PMMA) particles as an external additive are externally added to the toner and are attached to the charging member. However, when the amount of the PMMA particles to be attached to the charging member 1 is uneven or non-uniform, the toner fusion becomes noticeable in a portion carrying a small amount of the particles according to the same reason as described above.

As described hereinabove, in the conventional contact type charging device, there is posed a problem in that the toner, external additive, dust, etc., are unevenly attached to the charging member so as to cause improper charging or charging failure, and toner fusion.

SUMMARY OF THE INVENTION

An object of the present invention is to provide a charging device, a process cartridge and an image forming apparatus which are capable of preventing toner fusion (or toner fusing).

Another object of the present invention is to provide a charging device, a process cartridge and an image forming apparatus which are capable of preventing uneven attachment of foreign matter to the charging member to be used therein.

A further object of the present invention is to provide a charging device, a process cartridge and an image forming apparatus which are capable of preventing uneven or non-uniform charging.

According to the present invention, there is provided a charging device including a movable member to be charged, and a charging member which is contactable to the member to be charged so as to charge the member to be charged. The coefficient of dynamic friction between the member to be charged and a surface of the charging member contactable to the member to be charged is not lower than 0.4.

In another aspect, the present invention provides a process cartridge detachably mountable to an image forming apparatus. The process cartridge includes a movable image bearing member, image forming means for forming an image on the image bearing member, and a charging member which is contactable to the image bearing member to charge the image bearing member. The coefficient of dynamic friction between the image bearing member and a surface of the charging member contactable to the image bearing member is not lower than 0.4.

In another aspect, the present invention provides an image forming apparatus including a movable image bearing member, and a charging member which is contactable to the image bearing member to charge the image bearing member. The coefficient of dynamic friction between the image bearing member and a surface of the charging member contactable to the image bearing member is not lower than 0.4.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 4:
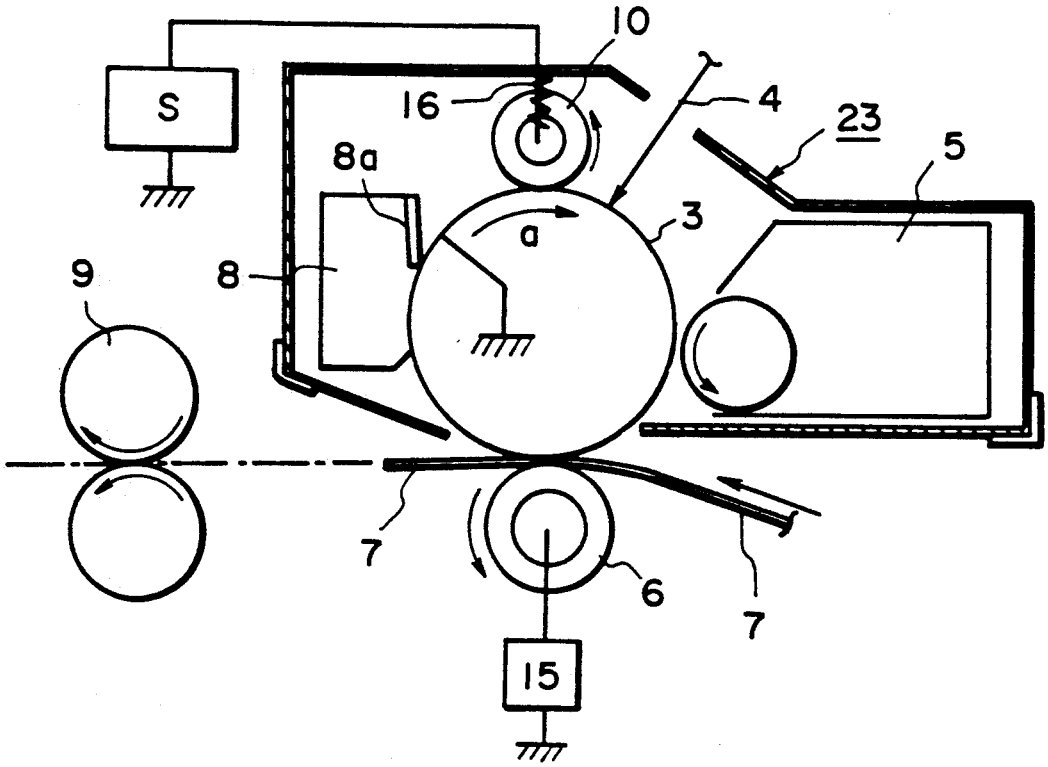
FIG. 4 is a schematic side view showing an embodiment of an image forming apparatus in the form of an electrophotographic printer using a charging device according to the present invention.

FIG. 4 is a schematic view showing an electrophotographic printer which uses a charging device according to the present invention as the charging means for charging an image bearing member.

(1) Structure of Printer

Referring to FIG. 4, the reference numeral 3 denotes an electrophotographic photosensitive member in the form of a rotating drum (photosensitive drum) as an image bearing member (or a member to be charged). In this embodiment, the photosensitive drum 3 comprises an OPC (organic photoconductor) photosensitive drum having a diameter of 30 mm which is driven so as to be rotated in the direction of an arrow a at a peripheral speed (process speed) of 100 m/sec.

Figure 1:
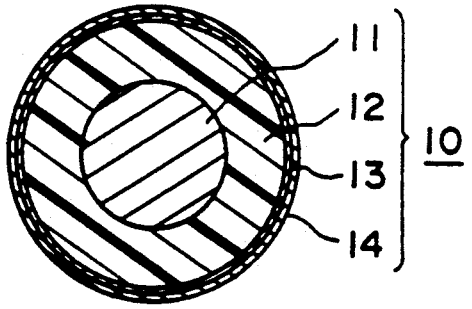
FIG. 1 is a cross-sectional view showing the layer structure of a charging roller according to a first or second embodiment of the present invention.

The reference numeral 10 denotes a charging roller as a charging member. The structure of the charging roller 1 will be specifically described in the item (2) appearing hereinafter. The charging roller 1 comprises a roller having a multi-layer structure as shown in FIG. 1 and having a diameter of 12 mm. The charging roller 1 is press-contacted to the photosensitive drum 3 with a total pressing force of 9.8N (Newton) by means of a pressing spring 16, and is rotated as a follower roller in accordance with the rotation of the photosensitive drum 3. The springs 16 presses the longitudinal opposite end portions of a metal core 11 constituting the charging roller 1. In this embodiment, the charging roller 1 is supplied from an electric source S with an oscillating voltage comprising a superposition of a DC voltage of −600 V corresponding to an intended potential of the charged photosensitive member, and an AC bias voltage comprising a sine wave which is constant-current controlled. In practice, the constant current value is controlled at 600 μA, the peak-to-peak voltage of the sine wave produced in the charging roller is 2,000 V. In such a case, the peripheral surface of the rotating photosensitive drum 3 is uniformly charged so as to have a potential of −600 V. The waveform of the oscillating voltage may also be a rectangular wave or a triangular wave, in addition to the sine wave as described above. Alternatively, such a waveform may also be a rectangular wave which has been formed by turning a DC voltage source on and off. In other words, a bias capable of periodically changing the voltage value thereof may be used as the oscillating voltage as described above.

The surface of the photosensitive drum 3 which has been subjected to the charging operation in the above manner is then subjected to scanning exposure 4 based on a semiconductor laser which has been intensity modulated in accordance with an image signal, by means of a laser scanner (not shown) as image information exposure means. As a result, a portion of such a surface which has been subjected to the exposure is discharged (i.e., the charge of such a surface portion is removed) and the resultant light portion based on the exposure has a uniform potential of −100 V, whereby an electrostatic latent image is formed.

The thus formed latent image is visualized or developed into a toner image by means of a developing device 5. In this embodiment, the developing device comprises a reverse development device which uses a magnetic one-component negative toner, and uses a jumping developing method as a developing system. In other words, the toner is attached to the light portion of the surface of the photosensitive drum based on the exposure light having a low potential so that the latent image is developed into a visual toner image.

The toner used in this embodiment, comprises a fine powder toner having an average particle size of 6 μm. To such a toner, 1.2 wt. % of silica is externally added for the purpose of maintaining the fluidity thereof and 0.1 wt. % of PMMA particles are externally added for the purpose of preventing the toner fusion.

In the contact type charging system wherein a charging roller 10 is used as a charging member, particularly in the contact type charging system according to this embodiment wherein a voltage including an AC component is applied to the charging roller 10 to effect the charging thereof, the toner which has passed through a cleaning blade 8*a* of a cleaning device 8 is pressed by and struck with the charging roller 10 in a press-contact portion between the charging roller 10 and the photosensitive drum 3. As a result, the toner is liable to be fused to the surface of the photosensitive drum 3, i.e., the toner fusion is liable to occur. For the purpose of preventing the occurrence of such a phenomenon, the above PMMA particles are externally added to the developer. The PMMA particles have a particle size of about 0.5 μm and it is liable to pass cleaning blade 8*a*. When the PMMA particles are attached to the charging roller 10, they function as a cushion between the charging roller 10 and the photosensitive drum 3 so as to reduce the above toner fusion.

The toner image formed on the photosensitive drum 1 under the action of the developing device 5 is sequentially transferred to a transfer material which has been supplied to a portion between a transfer roller 6 and the photosensitive drum 1 for paper supply means (not shown) with a predetermined timing. The transfer roller 6 is supplied with a high voltage of 2 KV from an electric source 15.

The toner particles remaining on the photosensitive drum which have not been transferred to the transfer material 7 are scraped off with the cleaning blade 8*a* of the cleaning device 8. The thus cleaned surface of the photosensitive drum is repetitively subjected to the image formation process.

On the other hand, the transfer material 7 to which the toner image has been transferred is passed through the transfer position and then separated from the surface of the photosensitive drum 1. Thereafter, the transfer material 7 carrying thereon the toner image is subjected to a heat and pressure fixing operation by a fixing roller 9, and discharged to the outside of the apparatus as an image formation product such as a print and copy.

The printer according to this embodiment is constituted by a printer main assembly and a process cartridge 23 which is detachably mountable to the printer main assembly for the purpose of improving the maintenance property of the apparatus. In this embodiment, the process cartridge 23 integrally comprises four process means, i.e., the photosensitive drum 3, the charging roller 10, the developing device 5 and the cleaning device 8. In the present embodiment, however, it is sufficient that the process cartridge 23 comprises at least the photosensitive drum 3 and the charging roller 10.

As shown in the schematic cross-sectional view of FIG. 1, the charging roller 10 according to this embodiment has a multi-layer structure comprising a metal core 11 comprising iron, SUS (stainless steel) etc., and having a diameter of 6 mm, and first, second and third functional layers 12, 13 and 14 sequentially disposed around the metal core 11. The charging roller has a total diameter of about 12 mm, and an effective length of about 230 mm in the longitudinal direction of the charging roller 10.

The first functional layer 12 comprises an electroconductive elastic (or elastomeric) layer which has been caused to have a conductivity (resistivity: about $10^3\ \Omega$) by dispersing conductive carbon in a butadiene rubber or an isoprene rubber. The layer 12 has a function of imparting an appropriate softness to the charging roller 10 so that the charging roller 10 may be contacted to the photosensitive drum 3 to provide a uniform nip width with respect to the respective portions thereof along the longitudinal direction of the charging roller 10. In this embodiment, the metal core 11 is coated with the first functional layer having a thickness of 3 mm. The first functional layer has a hardness of 55 degrees when it is measured by means of an Asker-C hardness meter under a load of 1 kg.

Figure 2:
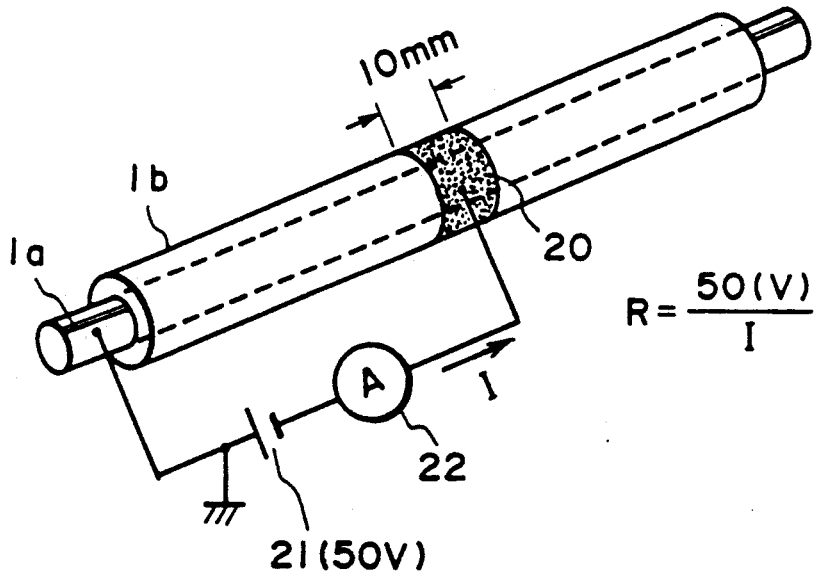
FIG. 2 (PRIOR ART)
FIG. 2 is a perspective view showing a method of measuring the resistance value of a charging

The second functional layer 13 comprises a resistance layer having a thickness of 200 μm, and the resistance thereof is controlled by dispersing conductive carbon in a urethane rubber. The resistance of the charging roller 10 including the metal core 11, the first functional layer 12 and the second functional layer 13 is on the order of $10^4\ \Omega$, when it is measured by the resistance measuring method as shown in FIG. 2 as described above.

The third functional layer 14 comprises a coating layer having a thickness of about 5 μm and comprising a nylon resin. The third functional layer 14 is disposed so as to prevent the bleeding from the first and second functional layers 12 and 13 as described above, and may preferably comprise N-methoxy-methylated nylon (e.g., one sold under the trade name of "Tresin"). When the third functional layer 14 comprises the nylon resin alone, the resistance thereof may be increased under a low-temperature low-humidity condition so as to cause improper charging. For the purpose of preventing the occurrence of such a phenomenon, an electroconductive filler is dispersed therein. In addition, a material other than the nylon resin such as rubber capable of preventing the bleeding may also be used as the material constituting the third functional layer 14.

Figure 3:
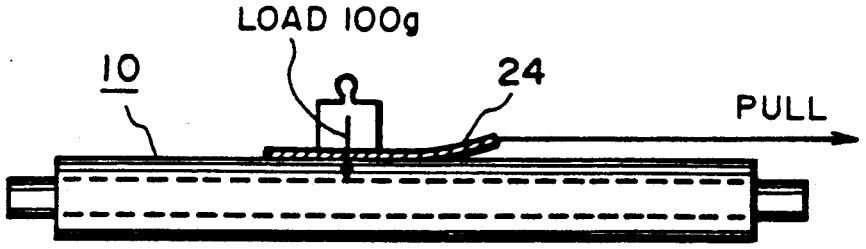
FIG. 3 (PRIOR ART)
FIG. 3 is a schematic view for illustrating a method of measuring a friction coefficient.

In general, electroconductive carbon or $SnO_2$ may be used as a filler for the coating layer. However, in the charging roller 10 having the above structure, when carbon is dispersed in the nylon resin constituting the third layer 14 as the coating layer, the friction coefficient of the surface of the charging roller is considerably decreased. In practice the friction coefficient is measured by means of a friction coefficient measuring device (trade name: Heidon-14) mfd. by Heidon Co. More specifically, as schematically shown in FIG. 3, a taping material 24 having a width of 10 mm and comprising a PET sheet and a coating layer of a material constituting the surface layer of the photosensitive drum is provided, and such a tape material 24 is pressed to the surface of the charging roller 10 under a load of 100 g and is pulled in such a condition. As a result, the coefficient of dynamic friction showed a value of 0.2.

Accordingly, in this embodiment, $SnO_2$ is used as the conductive filler to be dispersed in the nylon resin constituting the third layer as the coating layer in place of the conductive carbon so as to increase the friction coefficient (i.e., dynamic friction coefficient, the same in the description appearing hereinafter) of the surface of the charging roller 1. The $TiO_2$ used herein is one sold under a trade name of "T-1 (mfd. by Mitsubishi Kinzoku K. K.)", and 10 wt. % thereof is dispersed in the nylon resin (trade name: Tresin, mfd. by Teikoku Kagaku K. K.). The coating layer of the nylon resin is dried at 120° C. for 12 hours. When the above filler was used, the dynamic friction coefficient was increased up to 0.8 while it was 0.2 when the carbon or $SnO_2$ was used as the filler.

When the crosslinking of nylon is promoted, the hardness of the resultant film is increased and the friction coefficient is decreased simultaneously. In general, heat is applied to a material for the purpose of promoting the crosslinking, and an organic acid is added thereto as a crosslinking agent. According to the experiments by the present inventors, it has been confirmed that the crosslinking is remarkably accelerated in the case of the carbon or $SnO_2$ as compared with that in the case of $TiO_22$. Accordingly, in this embodiment, $TiO_2$ was used as the filler in place of $SnO_2$ for the purpose of increasing the friction coefficient without promoting the crosslinking.

With respect to the above printer as shown in FIG. 4, the following durability tests (successive image formation test) were effected under a high-temperature high-humidity condition (32.5° C., 85% RH).

(A) When the above charging roller having a friction coefficient of 0.2 was used, fog (or foggy background) was produced in the middle portion of the resultant image after about 2,000 sheets of transfer material (corresponding to A-4 size paper) were outputted. The fog was particularly noticeable in a half-tone image portion.

When the surface potential of a portion of the photosensitive member corresponding to the image having the fog was measured, it was found that the charging did not provide a desired potential and the potential was decreased by about 200 V as compared with that in the other portion.

When the surface of the charging roller was observed at this time, it was found that an uneven layer of the toner or PMMA particles (external additive) was formed on the surface of the charging roller surface. More specifically, in the middle portion of the roller where the pressure between the charging roller and the photosensitive drum was relatively low, a relatively thick layer was formed. As a result, it was found that improper charging occurred in the end portion of the roller. Particularly, it is considered that the toner used in this embodiment was an insulating toner and the PMMA particles had a high resistance, and therefore such a phenomenon provided a noticeable effect.

When a solid black image (i.e., an image formed by depositing toner particles on the entire image area) was outputted at this time, it was found that a large number of white spots appeared in both end portions of the image. In the portion of the photosensitive drum surface corresponding to such a portion, the toner particles were fused onto the drum surface. Accordingly, it was considered that in the above problematic image, the laser exposure to be applied to the photosensitive drum surface was obstructed by the above toner fusion so that the surface potential was not properly decreased, whereby the above white spots were produced in the resultant image on the basis of the reverse development.

The toner fusion is particularly caused when the toner particles disposed on the photosensitive member are struck on the basis of the vibration which has been produced in the charging roller due to the oscillating component such as AC voltage to be applied to the charging roller 10. In this embodiment, the occurrence of the toner fusion is prevented by externally adding the PMMA particles to the toner. However, in practice, the toner and PMMA particles were not attached to the charging roller in the end portion of the roller, and therefore the effect thereof for preventing the fusion was not provided.

(B) As described above, the improper charging in the middle portion of the image and the toner fusion in the end portion of the image are caused by the non-uniform attachment of the toner or PMMA particles to the surface of the charging roller. Accordingly, it is effective to intentionally coat the roller surface with a thin coating of the toner and PMMA particles. From such a viewpoint, the conductive filler to be dispersed in the third layer (i.e., nylon layer) 14 constituting the charging roller 1 was changed from $SnO_2$ to $TiO_2$, and the drying time was changed from 2 hours to one hour so as to provide a charging roller wherein the friction coefficient was increased from 0.2 to 0.9. By use of the resultant charging roller 10, a durability test was conducted in the same manner as described above.

As a result, it has been found that the fog in the middle portion of the image or the toner fusion in the end portion of the image did not occur at the time of the passage of 10,000 sheets, which are generally the service life of the process cartridge 23 according to this embodiment, while the above fog and toner fusion occurred at the time of the passage of 2,000 sheets when the charging roller which had not been improved in the above manner (A) was used. After the durability test, the surface of the charging roller was observed. As a result, it was confirmed that the entire surface of the roller was uniformly coated with the toner and PMMA particles so as to sufficiently prevent the toner fusion.

According to experiments by the present inventors, it was considered that the toner and PMMA particles were uniformly attached to the charging roller since the surface of the charging roller had a relatively large friction coefficient and therefore the toner particles, etc., were not scraped off with the photosensitive drum even when the charging roller was rubbed with the photosensitive drum. The limit of the friction coefficient which satisfied the above condition was determined in an experimental manner. As a result, it was found that the above effect was provided when a charging roller was constituted so that it had a friction coefficient of not smaller than 0.4 (more preferably, not smaller than 0.6), as shown in the following Table 1.

In Table 1 as shown below, with respect to the fog, the symbol "o" denotes a case wherein the fog did not occur, the symbol "x" denotes a case wherein the fog occurred and the resultant image was non-uniform. With respect to the toner fusion, the symbol "o" denotes a case wherein an improper image was not observed in the resultant letter image or solid black image, the symbol "Δ" denotes a case wherein an improper image was observed in the resultant letter image only, and the symbol "x" denotes a case wherein an improper image was observed in both of the resultant letter image and solid black image.

TABLE 1

| Friction coefficient | Improper charging (fog) | Toner fusion |
|---|---|---|
| 0.2 | x | x |
| 0.3 | x | x |
| 0.4 | o | Δ |
| 0.5 | o | o |
| 0.6 | o | o |
| 0.7 | o | o |
| 0.8 | o | o |

The above friction coefficient may also be charged depending on the surface roughness of the photosensitive drum and/or the charging roller. Accordingly, in the above case, the friction coefficient was measured under the condition that the ten-point mean roughness (Rz) of the photosensitive drum surface was 1 μm, and Rz of the charging roller surface was 3 μm.

In the above embodiment as described above, the friction coefficient of the charging roller surface is not smaller than 0.4 so that a uniform thin toner layer is intentionally formed on the charging roller surface, whereby the uneven contamination of the roller surface due to the toner, etc., in successive image formation is prevented. As a result, it is possible to stably provide good images without the toner fusion during the successive image formation.

Then, there will be described another embodiment wherein the friction coefficient of a charging roller with respect to a photosensitive drum is increased.

In this embodiment, the condition of the crosslinking of the nylon layer (third layer) 14 is changed for the purpose of increasing the friction coefficient of the surface of a charging roller 10. In the first embodiment as described above, the filler to the dispersed in the nylon layer 14 is changed from carbon or $SnO_2$ to $TiO_2$ so that the promotion of the crosslinking of the nylon is prevented to increase the resultant friction coefficient.

Similarly, when the drying condition (drying period of time) is shortened so as to control the promotion of the crosslinking, the same effect may be provided.

More specifically, it is conceivable that the crosslinking is controlled or suppressed (1) by lowering the drying temperature, or (2) by shortening the drying period of time (or drying time). However, on the basis of the following reasons, it is not possible to unconditionally weaken or suppress the crosslinking.

More specifically, in practice, a charging roller was prepared as a trial product by using a drying condition such that the charging roller was dried at 80° C. for 30 min., and the resultant charging roller was press-contacted to a photosensitive drum 3 and left standing under such a state for one month under a high-temperature high-humidity condition (50° C., 60% RH). As a result, the OPC (organic photoconductor) of a portion of the photosensitive drum 3 contacted to the charging roller was deteriorated by a substance bled from the charging roller 10 so as to provide an improper image.

As described above, when the crosslinking is simply weakened or suppressed, the nylon cannot perform its original function of a coating layer. Therefore, it is required to select a drying condition which is capable of providing the function of the coating and of maximizing the friction coefficient thereof.

Figure 5:
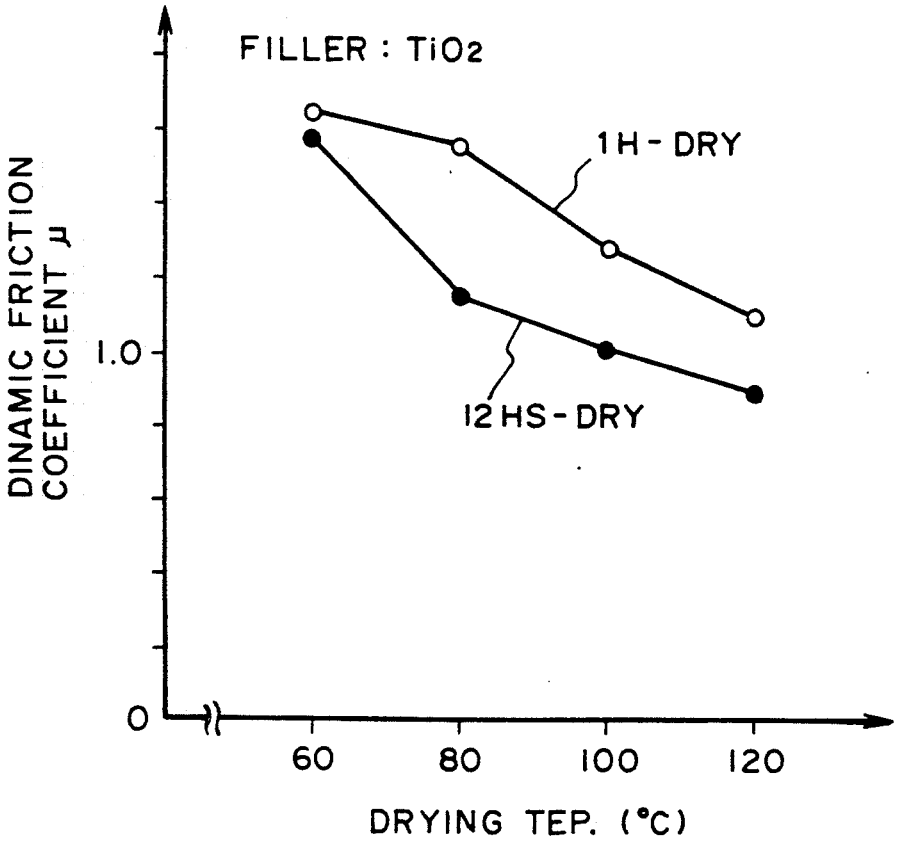
FIG. 5 is a graph showing a relationship between a drying condition and a friction coefficient.

From such a viewpoint, the change in the friction coefficient depending on the change in the drying condition was experimentally measured. The thus obtained results are shown in FIG. 5.

According to the experiments, it was found that the friction coefficient became larger as the drying temperature became lower or the drying time became shorter. On the basis of the above results, it was found that the friction coefficient was non-ambiguously (or definitely) decreased as the crosslinking was promoted. Accordingly, it is conceivable that when a minimum crosslinking is effected so as to prevent the bleeding, there is provided a charging roller which is capable of showing a maximum effect on the prevention of the charging unevenness (on charging non-uniformity) due to the toner fusion or uneven contamination of the roller, without posing a problem. In the above experiment, three samples were prepared as trial products by using three drying conditions wherein the charging rollers were dried at 60° C. for 30 min., at 60° C. for 45 min., and at 80° C. for 30 min., respectively. The thus prepared samples showed a very large friction coefficient which was larger than 2.0, but provided considerable bleeding. As a result, there samples were not usable in practice. Accordingly, it was found that the practically usable friction coefficient was not smaller than 0.4 and not larger than 2.0, regardless of the condition under which the charging roller was used.

According to the experiments by the present inventors, it was found that the practically minimum crosslinking which was capable of preventing the bleeding was provided under a condition such that the roller was dried at 120° C. for 45 min., as shown in the following Table 2. However, in consideration of a distribution in the temperature of the drying oven, etc., it was determined that the optimum drying condition was 120° C. and one hour.

TABLE 2

| | 60° C. | 80° C. | 100° C. | 120° C. |
|---|---|---|---|---|
| 30 min. | x | x | x | x |
| 45 min. | x | x | x | o |
| 60 min. | x | x | o | o |
| 2 hrs. | x | o | o | o |

In the above experiments, the conductive filler was $TiO_2$. In the above Table 2, the symbol "o" denotes a case wherein an improper image was not formed on the basis of the bleeding, and the symbol "x" denotes a case wherein an improper image was formed on the basis of the bleeding.

When $TiO_2$ was used as the conductive filler and the drying operation was conducted in accordance with the above conditions there was prepared a charging roller having a friction coefficient as large as 1.1. On the other hand, in a case where the drying operation was conducted at 120° C. for 12 hours, only a friction coefficient of at most 0.9, was obtained even when $TiO_2$ was used as the conductive filler.

When the thus prepared charging roller 10 was subjected to a test wherein it was left standing in contact with the photosensitive drum 3 under a high-temperature high-humidity condition, the roller did not cause bleeding therefrom. In addition, it was confirmed that much latitude could be provided with respect to the occurrence of the charging unevenness or toner fusion due to the contamination of the charging roller, even in a successive image formation test.

When the drying condition is made milder as in the present embodiment, a friction coefficient as large as 0.4 may be provided even when carbon or $SnO_2$, which cannot be used in the above first embodiment, is used as the conductive filler to be contained in the nylon layer 14. As a result, the charging unevenness due to the toner fusion or contamination is suppressed, and the resultant charging roller becomes practically usable without causing a problem.

When the charging roller as described above is intended to be uniformly coated with a toner or an external additive such as PMMA particles, it is preferred that the total pressure exerted between the charging roller and the photosensitive drum is not lower than 400 g. In addition, when the longitudinal direction of the charging roller is intended to be uniformly coated with the toner or external additive, it is also preferred that the charging roller is caused to have a crown shape so that the pressure exerted between the roller and the photosensitive drum becomes substantially uniform with respect to the middle portion and end portion of the charging roller.

In the embodiments as described above, a member in the form of a roller is used as the charging member. Hereinbelow, there will be described an embodiment wherein a member in another form is used as the charging member.

Figure 6:
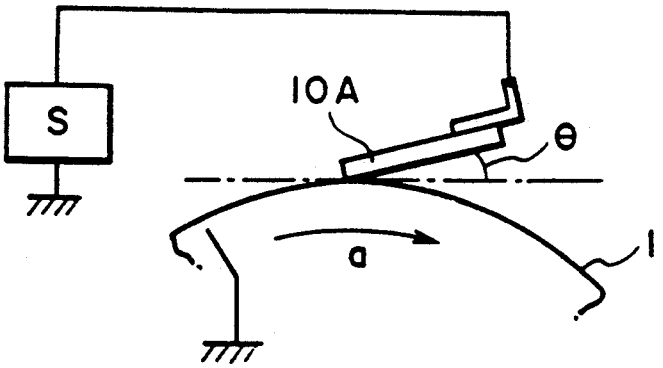
FIG. 6 is a schematic side view showing a third embodiment of the present invention which uses a charging blade.

In this embodiment, as shown in FIG. 6, a member in the form of a blade (charging blade) 10A is used as a contact charging member for charging the photosensitive drum 3. Such a charging blade 10A has advantages such that it may have a simpler structure and the cost thereof is lower, as compared with those of the charging roller 10. On the other hand, a conventional charging blade also has disadvantages such that the uniform contact with the photosensitive member is less liable to be assured and is liable to cause improper charging in the form of stripes, as compared with those in the case of the charging roller.

Figure 7:
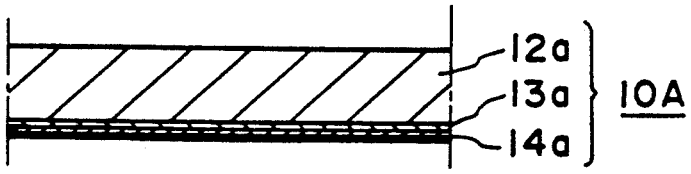
FIG. 7 is a cross-sectional view showing the layer structure of a charging blade.
Figure 8:
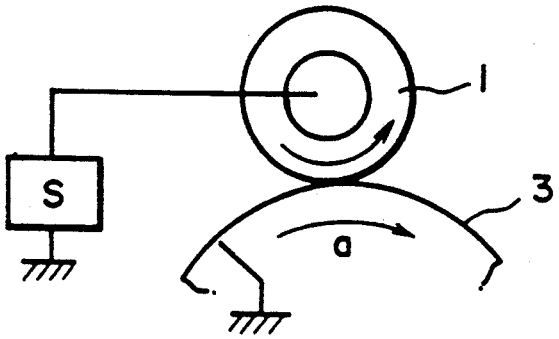
FIG. 8 (PRIOR ART)
FIG. 8 is a view for illustrating a contact type charging device.

The charging blade 10A prepared in this embodiment comprises substantially the same material as that of the charging roller 10 described in the first embodiment. More specifically, the charging blade 10A has a layer structure as shown in a schematic cross sectional view of FIG. 7, and comprises a blade base member 12a comprising a silicone rubber layer having a thickness of 2 mm, a resistance layer 13a disposed thereon and comprising a urethane rubber layer having a thickness of 200 μm, and a coating layer 14a disposed on the resistance layer and comprising a nylon layer having a thickness of 5 μm. The silicone rubber layer 12a had been provided with an electroconductivity by use of carbon, and the coating layer 14a has been formed by a coating process.

The thus prepared charging blade 10A was assembled in the electrophotographic printer as described in the above first embodiment with reference to FIG. 4 in place of the charging roller 10, and the image formation was effected by use of such an electrophotographic printer. In the above printer, the blade 10A was mounted so that it was caused to contact the photosensitive drum 3 with an angle of 15 degrees therebetween in the counter direction with respect to the rotating direction of the photosensitive drum. When a voltage was applied to the charging blade under the same conditions as those in the case of the charging roller, good images were provided.

Initially, carbon was used as the conductive filler to be dispersed in the nylon layer 14a and the drying operation was effected at 120° C. for 12 hours. The resultant charging roller was then subjected to a successive image formation test under a low-temperature low-humidity condition (15° C., 10% RH). As a result, after the successive image formation corresponding to the passage of 2,000 sheets or more, good images were outputted during a successive printing test. However, when an image was intended to be outputted after a long rest time (2 hours or more), improper charging in the form of stripes was observed with respect to several sheets in the initial stage. Such an improper image gradually disappeared by continuing the passage of sheets, but the same phenomenon was again observed when a rest time was interposed between the successive printing.

At this time, when the contact portion between the charging blade and the photosensitive member was observed, it was found that a portion of the charging blade wherein good charging operation was effected showed a clear surface but minute gaps or clearances were provided between the photosensitive member and a portion of the charging blade corresponding to the stripes, and the toner particles were attached to such a portion since it was not rubbed with the photosensitive member. As a result, it was found that the above portion corresponding to the stripes provided partial improper charging on the basis of the above gaps.

Such a phenomenon may be caused since the surface of the charging blade has a relatively low friction coefficient and a non-uniform portion is provided with respect to the deposition of the toner particles. Such a phenomenon may occur at a low temperature unlike the case of the above charging roller. The reason for this is that the base rubber 12a of the blade increases its hardness at a low temperature. This is a problem peculiar to the charging blade.

Ideally, it is preferred that the blade is completely contacted to the photosensitive member, and the entire contact portion of the blade is rubbed with the photosensitive member, whereby the toner particles are not attached to the blade. In practice, however, in order to attain such a contact state, it is necessary to considerably increase the contact pressure of the blade. Such a considerably high Pressure is liable to weaken the blade per se so as to pose a problem such that the contact rather becomes non-uniform on the basis of the weakening of the blade.

On the other hand, in this embodiment, the friction coefficient of the charging blade is increased so t hat the toner particles are caught by the contact surface of the blade with respect to the photosensitive drum. As a result, in this embodiment, a thin layer of the toner particles is formed on such a surface of the blade so as to prevent the occurrence of the non-uniformity in the toner deposition.

More specifically, similarly as in the above first and second embodiments, the filler to be contained in the nylon layer 14a was changed from carbon to $TiO_2$, and the drying temperature and the drying time were changed to 120° C. and one hour, respectively, so as to increase the friction coefficient of the charging blade 1A. The above drying condition was a limit at which the bleeding was effectively prevented. In this embodiment, the friction coefficient was increased from 0.2 to 1.1 in the above manner.

The thus prepared charging blade was subjected to a successive printing test in the same manner as described above. As a result, good charging operation could be effected during the successive printing period of time even when a rest period was interposed therebetween.

As a manner of course, in the embodiments as described hereinabove, the term "charging" also covers "discharging" wherein the potential level of the member to be charged is lowered, in addition to a case wherein the potential level of the member to be charged is raised.

In the present invention, the charging member may have an appropriate form or shape other than the roller form or blade form as described hereinabove. Specific examples of such a form may include a rod form, a block form, a wire form, a web form, etc.

As described hereinabove, the problem of the above charging unevenness or toner fusion due to the contamination of the charging member may be posed when a contaminating substance such as toner and dust is non-uniformly deposited or attached to the charging member and there is provided too large a difference in the amount of such a substance between a portion thereof carrying a relatively large amount of the above substance and a portion thereof carrying a relatively small amount of the above substance. Accordingly, even in a case where the charging member is contaminated with the contaminating substance, when the deposition or attachment of the contaminating substance to the respective portions of the charging member (i.e., degree of the contamination) is substantially uniform and the amount of the contaminating substance attached to the charging member is not excessive, it is possible to substantially retain the chargeability and charging uniformity. In addition, in such a case, the toner fusion can be prevented by uniformly depositing a toner external additive on the charging member.

Accordingly, in the present invention, even when the charging member is contaminated with a contaminating substance such as toner, the degree of the contamination is made uniform with respect to the respective portions of the contact surface between the charging member and the member to be charged, i.e., the contaminating substance such as toner is uniformly attached to the respective portions of the charging member mechanically, whereby the charging unevenness due to the non-uniform deposition is prevented and the toner fusion prevention effect of the toner external additive is heightened. In the present invention, the coefficient of dynamic (or kinetic) friction between the charging member and the member to be charged is not lower than 0.4, as described above so that the contaminating substance such as toner is uniformly attached to the respective portions of the contact surface between the charging member and the member to be charged.

Further, it is conceivable that even in a case where the degree of the above deposition is uniform, when the degree of the deposition is excessive, the voltage to be applied to the member to be charged is lowered so as to cause the improper charging. However, in the present invention, it has been found that the excessive deposition does not substantially occur since the charging member is rubbed with the member to be charged on the basis of the relative movement therebetween so that the contaminating substance excessively attached to the charging member is scraped off with the member to be charged.

What is claimed is:

1. A charging device, comprising:

a movable member to be charged, and a charging member which is contactable to the member to be charged so as to charge the member to be charged, wherein the coefficient of dynamic friction between the member to be charged and a surface of the charging member contactable to the member to be charged is not lower than 0.4.

2. A process cartridge detachably mountable to an image forming apparatus, the process cartridge comprising:

a movable image bearing member, and a charging member which is contactable to the image bearing member to charge the image bearing member, wherein the coefficient of dynamic friction between the image bearing member and a surface of the charging member contactable to the image bearing member is not lower than 0.4.

3. An image forming apparatus, comprising:

a movable image bearing member, image forming means for forming an image on the image bearing member, and a charging member which is contactable to the image bearing member to charge the image bearing member;

wherein the coefficient of dynamic friction between the image bearing member and a surface of the charging member contactable to the image bearing member is not lower than 0.4.

4. An image forming apparatus according to claim 3, which further comprises voltage application means for applying a voltage between the image bearing member and the charging member.

5. An image forming apparatus according to claim 4, wherein the voltage is periodically changed.

6. An image forming apparatus according to claim 5, wherein the voltage comprises a superposition comprising an AC voltage and a DC voltage.

7. An image forming apparatus according to claim 3, wherein the surface of the charging member contactable to the image bearing member comprises a surface of a resin layer.

8. An image forming apparatus according to claim 7, wherein the resin layer contains an electroconductive substance dispersed therein.

9. An image forming apparatus according to claim 7, wherein the resin layer comprises a nylon resin, and $TiO_2$ is dispersed in the nylon resin.

10. An apparatus according to claim 7, 8 or 9, wherein said charging member is crowned in its longitudinal direction.

11. An image forming apparatus according to claim 3, wherein the charging member has a roller shape.

12. An image forming apparatus according to claim 3, wherein the image forming means and the charging member are provided in a common unit.

13. An image forming apparatus according to claim 3, wherein the image bearing member comprises a photosensitive member.

14. An image forming apparatus according to claim 13, wherein the photosensitive member comprises a layer of an organic photoconductor.

15. An image forming apparatus according to claim 3, wherein the coefficient of the dynamic friction is not higher than 2.0.

16. An image forming apparatus according to claim 3, wherein the image forming means comprises developing means for developing an image formed on the image bearing member with a developer, and the developer comprises a polymethyl methacrylate resin.

17. An image forming apparatus according to claim 3 or 5, wherein the surface of the charging member contactable to the image bearing member is coated with a polymethyl methacrylate resin.

18. An apparatus according to claim 17, wherein said charging member is crowned in its longitudinal direction.

19. An apparatus according to claim 3, wherein the dynamic friction coefficient is not less than 0.6.

20. An apparatus according to claim 3, wherein a total pressure between said charging member and the image bearing member is not less than 400 g.

* * * * *

UNITED STATES PATENT AND TRADEMARK OFFICE

CERTIFICATE OF CORRECTION

PATENT NO. : 5,235,386

DATED : August 10, 1993

INVENTOR(S) : YANO ET AL.

It is certified that error appears in the above-indentified patent and that said Letters Patent is hereby corrected as shown below:

In the Drawings

Sheet 2

Figure 5, "DINAMIC" should read --DYNAMIC-- and "TEP." should read --TEMP--.

Sheet 3

Figure 9:
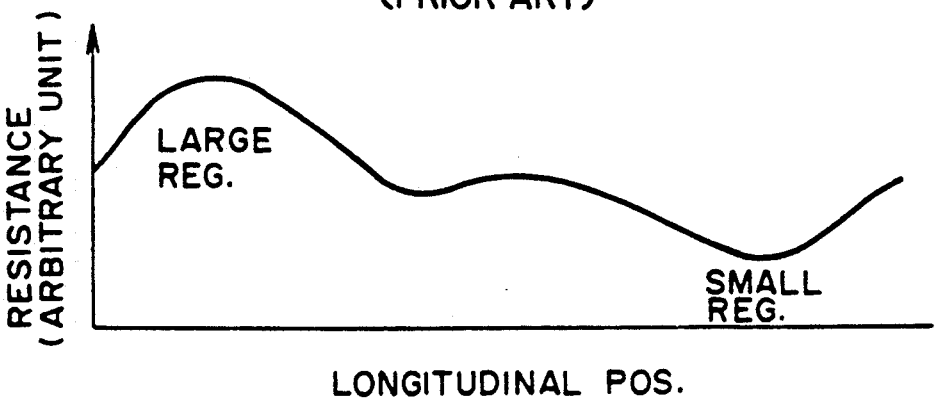
FIG. 9 (PRIOR ART)
FIG. 9 is a graph showing a state wherein the resistance of a charging roller is uneven or non-uniform with respect to the height thereof along the longitudinal direction of the charging roller.

Figure 9, "REG." should read --RES.-- (both occurrences).

Column 1

Line 26, "member,," should read --member,--.
Line 28, "have" should read --has--.
Line 30, "relatively" should read --a relatively--.
Line 32, delete "to be maintained".

Column 5

Line 18, "charging" should read --charging roller.--.

UNITED STATES PATENT AND TRADEMARK OFFICE

CERTIFICATE OF CORRECTION

PATENT NO. 5,235,386 Page 2 of 2

DATED August 10, 1993

INVENTOR(S) YANO ET AL.

It is certified that error appears in the above-indentified patent and that said Letters Patent is hereby corrected as shown below:

Column 6

Line 62, "it is" should read --they are--.

Column 9

Line 63, "are" should read --is--.

Column 14

Line 6, "Pressure" should read --pressure--.
Line 11, "t hat" should read --that--.

Signed and Sealed this

Nineteenth Day of April, 1994

Bruce Lehman

*Attest:*

BRUCE LEHMAN

*Attesting Officer*

*Commissioner of Patents and Trademarks*